United States Patent [19]

Wright

[11] 4,165,864

[45] Aug. 28, 1979

[54] CHICKEN WIRE BORDER FENCE

[76] Inventor: David M. Wright, 500 Leicester St., Auburn, Mass. 01501

[21] Appl. No.: 917,491

[22] Filed: Jun. 21, 1978

[51] Int. Cl.[2] ..... E04H 17/04; B21F 27/00

[52] U.S. Cl. ..... 256/34; 256/45

[58] Field of Search ..... 256/25, 33, 39, 35, 256/45

[56] References Cited

U.S. PATENT DOCUMENTS

| | | | |
|---|---|---|---|
| 386,721 | 7/1888 | Rickards et al. | 256/45 |
| 402,732 | 5/1889 | Gilbert | 256/33 |
| 603,628 | 5/1898 | Ferguson, Jr. | 256/45 |
| 2,651,502 | 9/1953 | Carvelo et al. | 256/33 |
| 2,667,335 | 1/1954 | Lewis | 256/33 |
| 2,777,673 | 1/1957 | May, Jr. et al. | 256/33 |
| 3,651,851 | 3/1972 | Curtis | 256/33 X |

*Primary Examiner*—Werner H. Schroeder

*Attorney, Agent, or Firm*—Charles R. Fay

[57] ABSTRACT

A chicken wire border fence comprising a length of chicken wire of relatively narrow width having welded thereto a series of separate heavier gauge cross pieces of wire having end portions thereof extending outwardly from one edge of the length of chicken wire in a reversed closed loop relationship, the other ends being open-ended and extending out from the opposite edge of the length of chicken wire in points for engaging the ground, the entire fence being capable of being rolled up for shipping and storing.

9 Claims, 2 Drawing Figures

CHICKEN WIRE BORDER FENCE

BACKGROUND OF THE INVENTION

There have been many wire border fences proposed and patented and in reference to this the following U.S. Pat. Nos. illustrate the art: 312,101, Elliott, Feb. 10, 1885; 659,416, Perry, Oct. 9, 1900; 697,259, Lavely, Apr. 8, 1902; Des. 74,041, Dec. 6, 1927.

The present invention utilizes a relatively inexpensive chicken wire of relatively narrow width together with heavier cross members welded to the chicken wire strengthening the same and holding the same erect, forming a unitary construction of strength and good appearance which can be rolled as chicken wire is conventionally rolled.

SUMMARY OF THE INVENTION

A relatively narrow width of chicken wire of any length desired has welded thereto wire cross members of heavier gauge, the cross members extending out in a reverse closed loop or hoop at one side edge of the chicken wire for easy handling and for good appearance. The wires of heavier gauge extend out from the other edge of the chicken wire to a length sufficient to form points for extending into the ground for holding the entire border fence erect. The cross members are welded at each intersection with any contiguous part of the chicken wire including the selvages at the edges of the chicken wire as well as at the twisted wire portions, etc.

PREFERRED EMBODIMENT OF THE INVENTION

A length of chicken wire is provided, the length of this wire being anything desired. In all probability the material would be sold in 25 or 50 foot lengths but one width which makes a border fence usable under many situations is eight inches; other widths, of course, may also be utilized as well.

Figure 1:
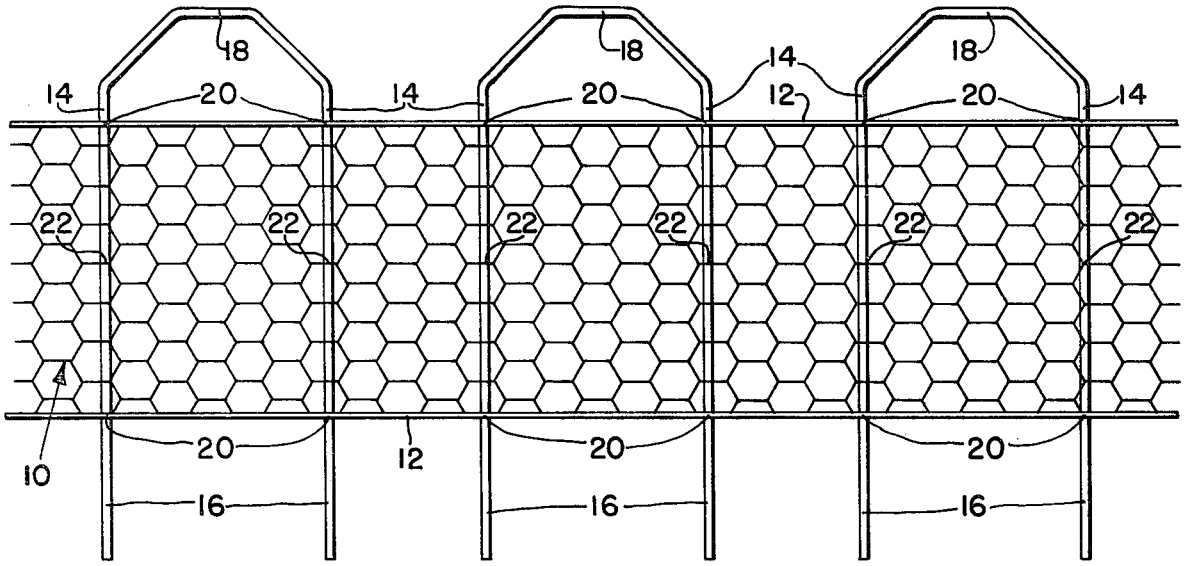
FIG. 1 is a view in elevation of one form of the invention.

The chicken wire is indicated in FIG. 1 by reference numeral 10 and this wire per se is old and well-known to those skilled in the art. It is formed of offset strands intertwisted and has double wire selvage edges 12,12 that are straight.

In FIG. 1 wire cross pieces of heavier gauge wire are provided to extend directly across the width of the chicken wire, these wires being indicated at 14,14. These wires are in U-shape, and are spaced as shown having extending ends 16 for engagement with the ground and at the opposite ends thereof they are connected as at 18, closing the U-shaped loops.

At all of the crossing points, indicated at 20 and 22, the cross pieces are welded with respect to the chicken wire, even at the selvages 12. It will be appreciated that this makes a very strong fence complete with means for holding it erect, the closed ends 18 forming means for handling it and preventing injury, and the U-shaped loops being spaced, providing for easy rolling up of the chicken wire in the usual manner for storage and for shipping.

Figure 2:
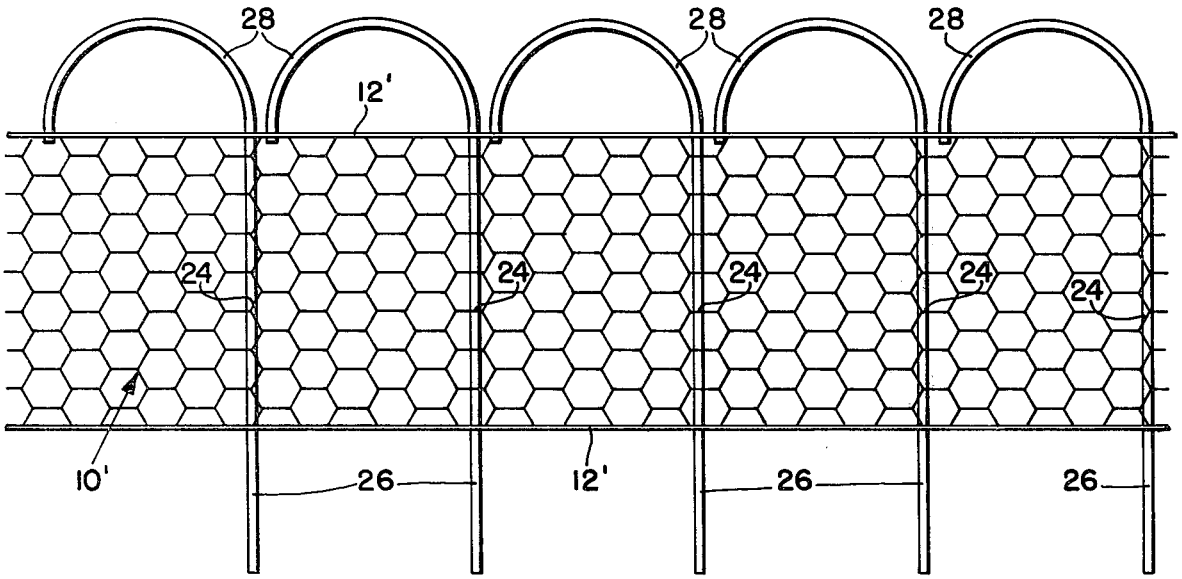
FIG. 2 is a view in elevation of a different form of the invention.

FIG. 2 shows a similar construction. The reference numeral 10' indicates a like length of chicken wire but the cross pieces in this case are indicated at 24. Again they are welded at every crossing of the chicken wire and extend out at the opposite side of the extending points 26 in a reversed loop 28 approaching but not connected to the adjacent cross piece, so as to allow for rolling of the wire in a roll as before, which is necessary to the storage and shipment of chicken wire products in general. The ends of reversed loops 28 are welded to the edge selvage wires 12'.

The loops 28 form hand holds and are safety means against injury in applying the border fence where it is desired by placing the points 26 in the ground, serving the same functions as the closed ends 18, in FIG. 1.

I claim:

1. A chicken wire border fence comprising a length of chicken wire having wire selvage edges, a series of spaced cross pieces of heavier gauge wire than the chicken wire, said cross pieces extending across the width of the chicken wire and extending therebeyond at both edges thereof, the portions of the cross pieces extending at one edge of the chicken wire forming ground engaging points mutually spaced along the length of the chicken wire, the portions of the cross pieces extending beyond the other edge of the length of the chicken wire being in the form of closed loops, said cross pieces being welded to the chicken wire including its selvage edges, and there being chicken wire between cross pieces, the loops being wholly independent so that the fence can be rolled up.

2. The chicken wire border fence of claim 1 wherein each cross piece is connected to another cross piece by a loop, forming inverted U-shaped members, the U-shaped members having closed ends forming the loops.

3. The chicken wire border fence of claim 1 wherein each loop has a portion terminating at a wire edge, forming J-shaped cross pieces.

4. The chicken wire border fence of claim 3 wherein the loop terminal is welded to the wire selvage edge.

5. The chicken wire border fence of claim 1 wherein the cross pieces and loops are located at one side only of the chicken wire.

6. A chicken wire fence comprising a length of chicken wire, wire edges on the chicken wire defining selvages, a series of spaced parallel cross pieces of heavier gauge than the chicken wire, said cross pieces extending across the width of the chicken wire and extending therebeyond at both edges thereof, the portions of the cross pieces extending at one edge of the chicken wire forming ground engaging members, the portions of the cross pieces extending at the other edge of the length of the chicken wire being reversely disposed to form loops, said loops terminating adjacent the said other edge of the chicken wire and being welded thereto at points apaced from the cross piece of which it is part, the welded terminal edge end portions of said cross pieces being spaced from the next adjacent cross pieces, whereby the chicken wire may be flexed at spaced points therealong for rolling the chicken wire in a bundle.

7. The chicken wire fence of claim 6 wherein each cross piece and its extending loop is in the form of a J.

8. A chicken wire fence comprising a length of chicken wire, wire edges on the chicken wire defining selvages, a series of spaced parallel cross pieces of heavier gauge than the chicken wire, said cross pieces extending across the width of the chicken wire and extending therebeyond at both edges thereof, the portions of the cross pieces extending at one edge of the chicken wire forming ground engaging members, the portions of the cross pieces extending at the other edge of the length of the chicken wire being reversely disposed to form loops, said loops crossing the said other edge of the chicken wire and being welded thereto at points spaced from the cross piece of which it is part, the welded portions of said cross pieces being spaced from the next adjacent cross pieces, whereby the chicken wire may be flexed at spaced points therealong for rolling the chicken wire in a bundle.

9. The chicken wire fence of claim 8 wherein the parts of the loops crossing the chicken wire edge extend across the chicken wire and extend past the said one edge thereof.

* * * * *